US011381049B2

(12) United States Patent
Glockseisen

(10) Patent No.: US 11,381,049 B2
(45) Date of Patent: Jul. 5, 2022

(54) PRESSING PLIERS NETWORK AND METHOD FOR PRESSING A WORKPIECE

(71) Applicant: WEZAG GmbH Werkzeugfabrik, Stadtallendorf (DE)

(72) Inventor: Thomas Glockseisen, Duesseldorf (DE)

(73) Assignee: WEZAG GMBH WERKZEUGFABRIK, Stadtallendorf (DE)

( * ) Notice: Subject to any disclaimer, the term of this patent is extended or adjusted under 35 U.S.C. 154(b) by 288 days.

(21) Appl. No.: 16/682,065

(22) Filed: Nov. 13, 2019

(65) Prior Publication Data

US 2020/0161822 A1 May 21, 2020

(30) Foreign Application Priority Data

Nov. 20, 2018 (EP) ..... 18207344

(51) Int. Cl.
*H01R 43/042* (2006.01)
*H01R 43/058* (2006.01)

(52) U.S. Cl.
CPC ..... *H01R 43/0421* (2013.01); *H01R 43/058* (2013.01)

(58) Field of Classification Search
CPC ..... B25B 27/146; B25B 7/04; H01R 43/042; H01R 43/0421; H01R 43/058
See application file for complete search history.

(56) References Cited

U.S. PATENT DOCUMENTS 4,794,780 A 1/1989 Battenfeld
5,913,933 A 6/1999 Beetz et al.
6,026,671 A 2/2000 Battenfeld
6,053,025 A 4/2000 Beetz et al.
(Continued)

FOREIGN PATENT DOCUMENTS

DE 37 08 727 C2 7/1988
DE 197 09 639 A1 9/1998
(Continued)

OTHER PUBLICATIONS

European Search Report in related, co-pending EP Application No. 19154272.9, dated Oct. 8, 2019.
(Continued)

*Primary Examiner* — Minh N Trinh
(74) *Attorney, Agent, or Firm* — Thomas | Horstemeyer, LLP

(57) ABSTRACT

The invention relates to a crimping pliers network (39) which comprises pressing pliers (2), an electronic control unit (31) (in particular a smartphone or a tablet) as well as a data storage device (37) (in particular a cloud storage (38)). According to the invention, a die (3, 4) of the pressing pliers (2) comprises an identifier (18, 19) which can be captured by a capturing device (21) of the pressing pliers. Data (48) from the data storage device (37) and being specific for the captured identifier (18, 19) is provided to the control unit (31). The data might be a desired pressing force curve (49), a desired pressing displacement curve (50) and/or information concerning a workpiece for which the dies (3, 4) are designated. In this way, it is possible to increase the process safety when using the crimping pliers (2). Furthermore, the invention relates to a method for pressing a workpiece.

20 Claims, 4 Drawing Sheets

(56) References Cited

U.S. PATENT DOCUMENTS

| | | | | |
|---|---|---|---|---|
| 6,286,358 | B1 | 9/2001 | Beetz et al. | |
| 6,289,712 | B1 | 9/2001 | Beetz et al. | |
| 6,474,130 | B2 | 11/2002 | Battenfeld | |
| 7,155,954 | B2 | 1/2007 | Battenfeld | |
| 8,516,872 | B2 | 8/2013 | Battenfeld et al. | |
| 9,864,948 | B2 | 1/2018 | Glockseisen | |
| 10,427,201 | B2 | 10/2019 | Bungter et al. | |
| 10,710,223 | B2 * | 7/2020 | Rosani | B25B 27/146 |
| 10,862,258 | B2 | 12/2020 | Battenfeld et al. | |
| 11,108,205 | B2 * | 8/2021 | Chahrour | B21D 39/048 |
| 2013/0233043 | A1 | 9/2013 | Kelly | |
| 2016/0016222 | A1 * | 1/2016 | Bungter | H01R 43/0428 29/515 |
| 2016/0363510 | A1 | 12/2016 | Kanack et al. | |
| 2017/0239788 | A1 | 8/2017 | Battenfeld | |
| 2018/0309256 | A1 | 10/2018 | Glockseisen | |
| 2019/0363502 | A1 | 11/2019 | Glockseisen | |
| 2020/0161822 | A1 * | 5/2020 | Glockseisen | B25B 7/04 |

FOREIGN PATENT DOCUMENTS

| | | | |
|---|---|---|---|
| DE | 198 02 287 | C1 | 12/1998 |
| DE | 197 13 580 | C2 | 12/1999 |
| DE | 198 07 737 | C2 | 6/2000 |
| DE | 198 34 859 | C2 | 1/2001 |
| DE | 199 63 097 | C1 | 4/2001 |
| DE | 199 24 087 | C2 | 6/2002 |
| DE | 199 24 086 | C2 | 8/2002 |
| DE | 197 53 436 | C2 | 10/2002 |
| DE | 203 17 913 | U1 | 3/2004 |
| DE | 103 46 241 | B3 | 8/2004 |
| DE | 10 2013 203 553 | B3 | 7/2014 |
| DE | 20 2014 011 110 | U1 | 1/2018 |
| EP | 2 305 428 | A1 | 9/2009 |
| EP | 2698885 | A1 | 2/2014 |
| EP | 2 995 424 | A1 | 9/2014 |
| EP | 3 208 044 | A1 | 2/2016 |
| EP | 3 396 796 | A1 | 4/2017 |
| EP | 3 572 188 | A1 | 5/2018 |
| WO | 2016005838 | A1 | 1/2016 |
| WO | 2016198973 | A1 | 12/2016 |

OTHER PUBLICATIONS

Product catalogue "Werkzeuge für die professionelle Anwendung" (publication No. 10/11) of the WEZAG GmbH Werkzeugfabrik company, Nov. 1, 2011.

Publication "Crimptechnik, Herstellung prozesssicherer Verbindungen von elektrischen Leitern und Steckern" of the WEZAG GmbH Werkzeugfabrik company, Die Bibliothek der Technik 342, Verlag Moderne Industrie, ISBN 978-3-68236-027-7 (Oct. 12, 2011).

* cited by examiner

PRESSING PLIERS NETWORK AND METHOD FOR PRESSING A WORKPIECE

CROSS REFERENCE TO RELATED APPLICATIONS

This application claims priority to co-pending European Patent Application No. EP 18 207 344.5 filed on Nov. 20, 2018.

FIELD OF THE INVENTION

The invention relates to a pressing pliers network with pressing pliers, which are actuated by the application of forces by a user upon hand levers of the manual pressing pliers.

For the design of the pressing pliers, there are the following variants:

a) It is possible that the pressing pliers are embodied as crimping pliers which in particular serves for producing a durable mechanical connection and an electrical contact. This is preferably achieved by crimping a plug to a cable or to an electrical conductor of any kind. Depending on a profile of dies employed, with the crimping pliers different crimping processes can be executed. For example, the crimp might be a closed crimp in which the conductor is inserted into a closed crimping zone of a plug or into a closed sleeve and is crimped by plastic deformation of the crimping zone or the sleeve. However, it is also possible that an open crimp is produced in which the plug comprises an open crimping zone into which the conductor can be inserted from above. To mention only some examples not limiting the invention, with the crimping pliers workpieces such as

- terminals according to German standard DIN 4623,
- aluminum connectors according to DIN 46329,
- aluminum press-fit terminals according to DIN 48201,
- crimp terminals according to DIN 46234,
- pin terminals according to DIN 46230 or
- connectors, plugs or terminals for a connection to a cable or conductor as described in the product catalog "Werkzeuge für die professionelle Anwendung" of WEZAG GmbH Werkzeugfabrik (publication no. 10/11)

can be crimped. For a closed crimp the produced crimp may be a hexagonal crimp, a square crimp, a B crimp, a trapezoidal crimp, a modified trapezoidal crimp, an oval crimp, a mandrel crimp or a double mandrel crimp. An open crimp may e.g. be realized as a V crimp or B crimp, a rolled crimp or a double rolled crimp.

In addition to establishing the electric connection between cable and conductor and plug, a mechanical connection may be established by means of a so-called insolation crimp. Here, a closed insolation crimp or an open insolation crimp (especially a V crimp or B crimp, O crimp or OV crimp) may be employed. With regard to further information

- on a design of generic crimping pliers,
- on possible applications of generic crimping pliers and/or
- on different possible types of crimp connections which can be produced with the generic crimping pliers reference is made to the document

- "Crimptechnik, Herstellung prozesssicherer Verbindungen von elektrischen Leitern and Steckern" of WEZAG GmbH Werkzeugfabrik (Die Bibliothek der Technik 342, Verlag Moderne Industrie, ISBN 978-3-68236-027-7).

Crimping pliers in different constructions are e.g. known from the documents DE 37 08 727 C2, DE 197 13 580 C2, DE 197 53 436 C2, DE 198 02 287 C1, DE 198 07 737 C2, EP 3 208 044 A1 and EP 2 305 428 A1.

b) It is also possible that the pressing pliers are embodied as (pipe) pressing tongues which serve to establish fluid-tight mechanical connections in fluid technology, e.g. for connecting pipes to each other or for connecting pipes to fluidic connector plugs. By means of the pressing tongues, the pipes to be connected or a fitting to provide mechanical connection and fluid-tight sealing are plastically deformed. Exemplary embodiments of generic pressing tongues can be seen from the publications DE 197 09 639 A1, DE 198 34 859 C2, DE 199 24 086 C2, DE 199 24 087 C2, DE 199 63 097 01, DE 103 46 241 B3, EP 2 995 424 A1.

Pressing pliers are used for pressing a workpiece. This workpiece might be a constructional group. For the embodiment of the pressing pliers as crimping pliers the workpiece might e.g. be a constructional unit comprising a plug and an electrical conductor (in some cases with an additional sealing element). Instead, for the embodiment of the pressing pliers as pressing tongues the workpiece might be the fitting (in some cases with the pipe arranged therein or a connecting element and any sealing element).

The publication WO 2016/005838 A1 discloses a crimping tool comprising a motor and two crimping jaws which can be pressed towards each other by the motor. In the crimping tool a control system monitors at which point in time a closed position of the crimping jaws is reached and at this point in time the motor is automatically switched off. It is possible to determine in different ways that the pliers jaws have reached the closed position. One of the disclosed methods comprises a determination which type of crimping jaws has been inserted into the crimping tool. For each type of crimping jaws, the stroke of a reference point at the crimping jaw between an opened position and a closed position of the crimping jaws is known. The actually reached displacement of the reference point is measured and compared to the known stroke so that for each type of crimping jaws it is possible to individually determine on the basis of the reached displacement of the reference point that the crimping jaws have been closed. The determination of the type of the crimping jaws might base on a detection of the mechanical shape, an optical detection or a detection based on the color, a magnetic or electric detection or on a signal of an RFID-tag. In a similar way it is also possible to determine which kind of workpiece has been inserted into the crimping pliers. Alternatively to the detection based on the type of the crimping jaws it is also possible to detect that the crimping jaws have reached the closed state on the basis of a measured pressure change or a measured change of the power consumption of the motor. A display connected to the control circuit might also indicate which operating mode has been chosen or which maximum crimping force has been reached and a result of the crimping process can be displayed.

The document US 2013/0233043 A1 discloses a crimping tool which can be actuated automatically or by hand. In the crimping tool it is monitored how many crimping cycles have been run through by the crimping tool and if due to the number of executed crimping cycles a maintenance is required. By a sensor it is determined how many crimping cycles have been executed. The sensor registers if two hand levers of the crimping tool have approached each other. The crimping tool comprises a micro-controller embodied as a counter. A storage unit of the micro-controller can be read by an external device via a wireless data transmission. It is possible to reset or re-program the micro-controller by the external device. It is also possible that the micro-controller transmits an identifier of the crimping tool to the external device.

SUMMARY OF THE INVENTION

The invention bases on the object to improve a pressing pliers network and a method for pressing a workpiece with respect to a simplification of the process, the process safety and/or a process documentation.

For one solution of the object of the invention, the pressing pliers which are designed for pressing a workpiece comprise (at least) one die accommodation in which an exchangeable die can be accommodated. The die might e.g. be screwed or clipped to the die accommodation (cp. also the connection of a die with a die accommodation according to the patent DE 198 02 287 C1).

In the case that the pressing pliers are embodied as pressing tongues or crimping pliers, the die accommodation might be provided by the pliers jaw.

It is possible that the pressing pliers comprise a (preferably electronic) capturing device. The capturing device is configured for capturing an identifier of the die.

According to the prior art, the user has to ensure during the transfer of the die to the die accommodation of the pressing pliers that for each specific workpiece the predetermined die for pressing the workpiece is arranged in the die accommodation of the pressing pliers. Any documentation and evaluation e.g. of pressing forces of the pressing pliers during the pressing process of the workpiece relies on the assumption that the predetermined die is arranged in the die accommodation.

Instead, the pressing pliers of one embodiment of the invention are able to capture information in the form of an identifier of the die arranged in the die accommodation. This leads to an increase of the process safety because it is possible to detect if the predetermined die, the predetermined type of die or also a type of a die from a group of admissible types of dies is arranged in the die accommodation. The die captured on the basis of the identifier can then also be documented in a process documentation. It is also possible to control the process during the pressing of the workpiece on the basis of the captured identifier of the die and/or it is possible to use evaluation parameters being specific for the die as e.g. desired pressing force curves.

Pressing pliers (or a pressing pliers set comprising the pressing pliers and the die) are used or operated in the pressing pliers network. The pressing pliers network comprises an electronic control unit which is formed and arranged externally (and in some cases remote) from the pressing pliers. The control unit might e.g. be a PC, a tablet, a laptop or a smartphone. This electronic control unit then communicates via a first communication link with the capturing device of the pressing pliers. For this purpose, also an electronic control unit can be used which might be a component of the capturing device in the pressing pliers or might communicate with the capturing device. Here, the communication might be wirelessly (in particular via bluetooth or WLAN) or cable-based. For this purpose, the pressing pliers might comprise a wireless transmitting device and/or receiving device or might have a port for a suitable cable connection (in particular an USB port). Here, the communication might be uni-directional from the pressing pliers to the electronic control unit or vice versa. However, preferably the communication is bi-directional. The communication might (as will be further explained in the following) serve e.g. for the purpose of documenting the specific die inserted into the pressing pliers, for providing information with respect to the workpiece which can be processed with the captured die, for providing characteristic data for evaluating the crimping process (to mention only some non-limiting examples).

The electronic control unit arranged externally from the pressing pliers communicates via a second communication link with an external data storage device where this communication might be transmitted via a public network which might require a suitable encoding. The external data storage device might e.g. be a cloud storage. Here, it is possible that different users of pressing pliers access a common data storage device (in particular a common cloud storage) which is then provided by a central person or a central company (e.g. the manufacturer of the pressing pliers).

If in the following reference is made to an electronic control unit, the electronic control unit might be a component of the pressing pliers and here in particular cooperates with the capturing device or forms the capturing device. However, it is also possible that this electronic control unit is an electronic control unit which is formed and arranged externally from the pressing pliers where in some cases the electronic control unit communicates with the external data storage device or cloud storage.

For one embodiment of the invention the control unit comprises control logic by which it is possible to download data from the data storage device which is specific for the captured identifier of the die. The data is characteristic for a desired pressing force curve and/or a desired pressing displacement curve. The characteristic data might e.g. be a desired pressing force curve over time, the desired pressing force curve over the desired pressing displacement curve, maxima, minima, inclinations and the like of the desired pressing force curve or of the desired pressing displacement curve. Accordingly, characteristic data for different desired pressing force curves and/or desired pressing displacement curves which are generated by different pressing pliers, workpieces and/or dies can be stored in the data storage device or in the cloud storage. On the basis of the captured identifier of the die (and in some cases under additional selection of the pressing pliers and/or of the workpiece to be pressed) it is then possible to download the characteristic data being specific for the captured identifier from the data storage device. In this case, the pressing pliers comprise at least one sensor or switch. The sensor or switch can be used for sensing an actual pressing force signal or an actual pressing displacement signal when running through the crimping stroke during which in a crimping process the workpiece is pressed by the die arranged in the die accommodation. The control unit then comprises control logic for evaluating the pressing process. This evaluation is performed under consideration of characteristic data on the one hand with respect to the desired pressing force curve and/or the desired pressing displacement curve and on the other hand under consideration of the actual pressing force signal and/or the actual pressing displacement signal. For mentioning only one example for explanation purposes, the evaluation can be performed by checking if a maximum of the sensed actual pressing force signal is within a predetermined tolerance region of the maximum of the desired pressing force signal. Dependent on the result of the evaluation, then an output can be generated at the output device, a corresponding documentation can be generated, the pressing process can be terminated or the pressing pliers might be brought out of operation for further pressing processes and the like.

It is possible that for one embodiment of the invention a workpiece specification device is provided. By means of the workpiece specification device, it is possible to input or capture a workpiece specification of a workpiece which is to be pressed with the pressing pliers. It is e.g. possible that at the external electronic control unit a workpiece number being specific for the workpiece or the plug (cp. the contact numbers as 25291 of plugs according to the brochure "Werkzeuge für die professionelle Anwendung" of the applicant (publication October 2011) and in some cases also a number of the cable which is to be pressed with the plug) can be input or selected at the external electronic control unit (in particular the laptop, PC or smartphone) by means of a keyboard or a control panel. However, it is e.g. also possible that the workpiece is captured by a camera of the smartphone, tablet or laptop or by an external camera. By means of an image recognition it is possible to identify the workpiece and basing thereon to assign a workpiece specification. It is also possible that the workpiece specification device comprises a barcode scanner which captures a barcode being specific for the workpiece. For this embodiment, the electronic control unit comprises control logic which on the one hand on the basis of the identifier of the die captured by the capturing device and on the other hand on the basis of the workpiece specification analyses if the die is suitable for pressing the workpiece comprising the workpiece specification. For this analysis, the electronic control unit might access an external data storage device or the cloud storage where in a suitable format the admissible combinations of dies and workpieces are stored in a way allowing a download. Dependent on the result of the analysis, then an entry is made into a documentation and/or an output for the user is produced.

The capturing device might generally be arranged at any location of the pressing pliers. For one particular proposal of the invention, the capturing device and/or an electronic control unit are/is arranged in the region of a pliers head of the pressing pliers. A pliers head of this type might be arranged between pliers jaws and the hand levers and might comprise a fixed housing. Here, it is possible that the capturing device is integrated into a "Tech-Pack" of the pliers head or integrated into an electronic constructional unit provided separately from the mechanical pliers part as being described in the not pre-published European patent application with the official application number EP 18 173 803.0. This European patent application is incorporated by reference into the present European patent application with respect to

- the use of the electronic constructional unit for other functions,
- the constructive, electrical and/or electronic design of the electronic constructional unit and
- the connection of the electronic constructional unit to the mechanical pliers part.

Another embodiment of the invention proposes that the capturing device is arranged in the region or adjacent to the die accommodation.

The capturing device might be arranged in the region of the pliers head or even in the region of a pliers jaw. To mention only another example, the distance of the capturing device from the die accommodation might be smaller than 10 cm, smaller than 5 cm, smaller than 4 cm, smaller than 3 cm, smaller than 2 cm or even smaller than 1.5 cm. Here, it is even possible that the capturing device extends into the region of the die accommodation itself.

For the type of the identifier transmitted between the die and the capturing device and the transmission device there are a lot of options from which in the following only some options are mentioned as examples:

- The pressing pliers might be used in a pressing pliers set with a die which comprises an optical coding which contains the identifier. As one option for an optical coding of this type, a barcode, a sequence of ciphers or a QR-code can be mentioned. In this case, the capturing device of the pressing pliers might comprise a reading device by which it is possible to sense or capture the optical coding. This reading device might e.g. be a kind of camera or a scanner for the optical coding.
- It is also possible that in the pressing pliers set a die is used which comprises a mechanical contact contour which provides the identifier. In this case, the capturing device comprises a mechanical sensing device or scanning device for the mechanical contact contour. To mention only one non-limiting example, the mechanical scanning device might comprise a scanning pin or scanning roller which is moved along the mechanical contact contour. The sensed signal of the displacement of the scanning pin then contains the identifier. However, it is also possible that a row or a field of scanning pins is pressed against a mechanical contact contour so that the scanning pins are then displaced to different extents corresponding to the mechanical contact contour. On the basis of the displacements of the scanning pins it is then possible to capture the identifier coded by the contact contour.
- Furthermore, it is possible that the die comprises an RFID unit by which the identifier is provided. The RFID unit in particular sends a high frequency or radio frequency signal which contains the identifier. In the case that the RFID unit is embodied as a passive unit, the RFID unit might be embodied without any own power supply. In this case, the RFID unit is supplied with electric power in per se known fashion by an external excitation by an excitation unit (which might also be a component of the pressing pliers) which then allows the sending of the signal comprising the identifier. The capturing device comprises a receiving unit which is able to receive the signal sent by the RFID unit.

As a special embodiment for this type of identifier and/or transmission of the identifier between the die and the pressing pliers, a technology might be used which is also denoted as "near field communication" (abbreviated "NFC"). This is an international transmission standard basing on the RFID technique for the contact-free exchange of data via electromagnetic induction by use of loosely coupled spools via short distances of some centimeters where the transmission rate of data might be limited to a maximum of 424 kBit/s. Here, a contact-free transmission might be provided by means of passive HF-RFID-Tags according to ISO/IEC 14443 or ISO/IEC 1563 or there might be a transmission based on a connection between equivalent active transmitters.

With respect to further information to RFID and NFC optionally usable within the frame of the invention, reference is made to the entry to "NFC" as well as "RFID" under Wikipedia (date of inspection Nov. 10, 2018) and the publications listed therein as well as standard publications related to RFID and NFC, in particular Klaus Finkenzeller: "RFID-Handbuch: Grundlagen und praktische Anwendungen von Transpondern, kontaktlosen Chipkarten und NFC", Carl Hanser Verlag GmbH+Co. KG, 7th edition, ISBN: 9783446439436.

It is also possible that in a pressing pliers set a die comprises a radiation emitter or light emitter which emits the identifier coded in a radiation signal or light signal. In this case, the capturing device comprises a receiver for the radiated signal or the light signal. For the kind of radiation or of the light, for the emitter used in the die and/or for the receiver used in the capturing device of the pressing pliers there are lot of options. The emitter might e.g. be an infrared emitter, a light cell or a diode. It is possible that the identifier is coded by a frequency and/or an amplitude of the emitted radiated signal or light signal where also other transmission forms or coding forms known from the transmission technique or communications engineering can be used.

Furthermore, it is possible that a transmission of the identifier is provided by an inductive coupling device providing an inductive coupling between the die and the capturing device. Here, the identifier is transmitted by an electromagnetic induction. For this purpose, a signal might e.g. be transmitted between a receiving unit and an associated transponder by activation and deactivation of a high-frequent magnetic field which might correspond to an amplitude modulation. In the transponder an electric voltage is induced in a coil which might then be rectified by a diode. However, also other embodiments are possible.

For the embodiment of the identifier of the die which is captured by the capturing device, within the frame of the invention there are a lot of options of which only some examples will be mentioned in the following:

It is possible that the identifier is an identifier of the type of the die so that a plurality of dies of the same construction or also dies of different construction which have a common characteristic feature or which are intended for the same or similar application(s) might comprise the same identifier.

However, it is (alternatively or cumulatively) also possible that the identifier is unique and specific for the specific die so that the dies have different identifiers each and it is possible to use calibration data, desired pressing force curves associated with the specific die and to exactly document in a process documentation which die had been used for pressing a workpiece.

Finally, it is also possible that the identifier is an authentication of the die on the basis of which e.g. an evaluation is possible if an original die or a plagiarism not being authenticated had been used.

Preferably, in the pressing pliers set at least one exchangeable die comprises a recess or inner chamber. In the recess or inner chamber then a transmitting unit (in particular an RFID unit) can be accommodated that transmits the identifier. Alternatively or cumulatively, in the recess or in the inner chamber a transmitting unit for a position signal (in particular a GPS signal) can be arranged which is generated by a GPS unit which might also be integrated into the inner chamber, the recess or another recess of the die. The inner chamber or the recess might be open in outer direction or might be closed by a lid or a layer of varnish or any other cover so that also a transfer of humidity or contaminations to the transmitting unit can be avoided and/or mechanical damages of the transmitting unit can be avoided. Here, the cover, the lid or the layer of varnish is preferably made of a material which comprises a high transmissibility for radiation for the signal sent by the transmitting unit. Preferably, the transmissibility for radiation of the cover, lid or layer of varnish is at least 20%, at least 50%, at least 100% or even at least 200% higher than the transmissibility for radiation of a base material of the die, where this in particular applies in a frequency region of 1.5 GHz to 3 GHz, preferably in a frequency region of 2.0 to 2.8 GHz or 2.2 to 2.6 GHz, or in a frequency region of 500 MHz±5%, ±10% or ±20%, 1800 MHz±5%, ±10% or ±20% or 1900 MHz±5%, ±10% or 20%.

Here, the transmissibility for radiation is in particular defined according to the standards ASTM D4935-10, IEEE Std 299-2006, IEEEE Std 1128-1998 and ASTM A698/A698M-07.

Preferably, the recess (which might be embodied as a milled-out portion or bore) is arranged in a flange section of the die which is covered by the pliers jaw. Here, a longitudinal extension of the recess or a bore for accommodating the transmission unit preferably has an orientation transverse to the pliers head plane or pivoting plane of the dies or is arranged in this plane, where in the last mentioned case the longitudinal axis might also have an orientation parallel to the pressing force which biases the dies.

For one proposal of the invention, the electronic control unit comprises control logic which controls an output device. Here, the control of the output device bases on the identifier of the die captured by the capturing device. For an alternative or cumulative embodiment, the control of the output device bases on data from the data storage device, the data being specific for the captured identifier. Here, the control of the output device by the control unit is such that an output is generated which contains information related with the type of a workpiece which can be pressed with the die inserted into the pressing pliers. It is e.g. possible that in the case that the pressing pliers are crimping pliers, the output contains information which type of plug, which types of plugs, which cable or which types of cable and/or in some cases which additional sealing can be crimped with the die of which the identifier has been captured. On the basis of the information provided for the user via the output, the user is then able to select the plug, the cable and in some cases the sealing or to check if the die is suitable for the present workpiece. However, it is also possible that on the basis of the output the user gets aware that the present die is not suitable for the workpiece which is to be pressed so that the user is able to insert another die into the pressing pliers.

Alternatively or cumulatively, it is possible that the control unit of the electronic control unit controls an output of an output device or an entry into a data storage device on the basis of the identifier of the die captured by the capturing device and/or on the basis of data from the or a data storage device. The output or the entry then contains an information that the die is not authenticated for the use in the pressing pliers. In this way, it is possible to document or bring to the knowledge of the user that e.g. a plagiarism of the die is inserted into the pressing pliers or a die which is not suitable for the used type of the pressing pliers has been inserted into the die accommodation. Additional to the generation of the output or the entry, also further measures can be taken, as e.g. the generation of a warning signal or warning sound. In an extreme case, it is even possible that the pressing pliers are switched out of operation in order to disable an operation of the same with a die which is not authenticated.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION

Figure 1:
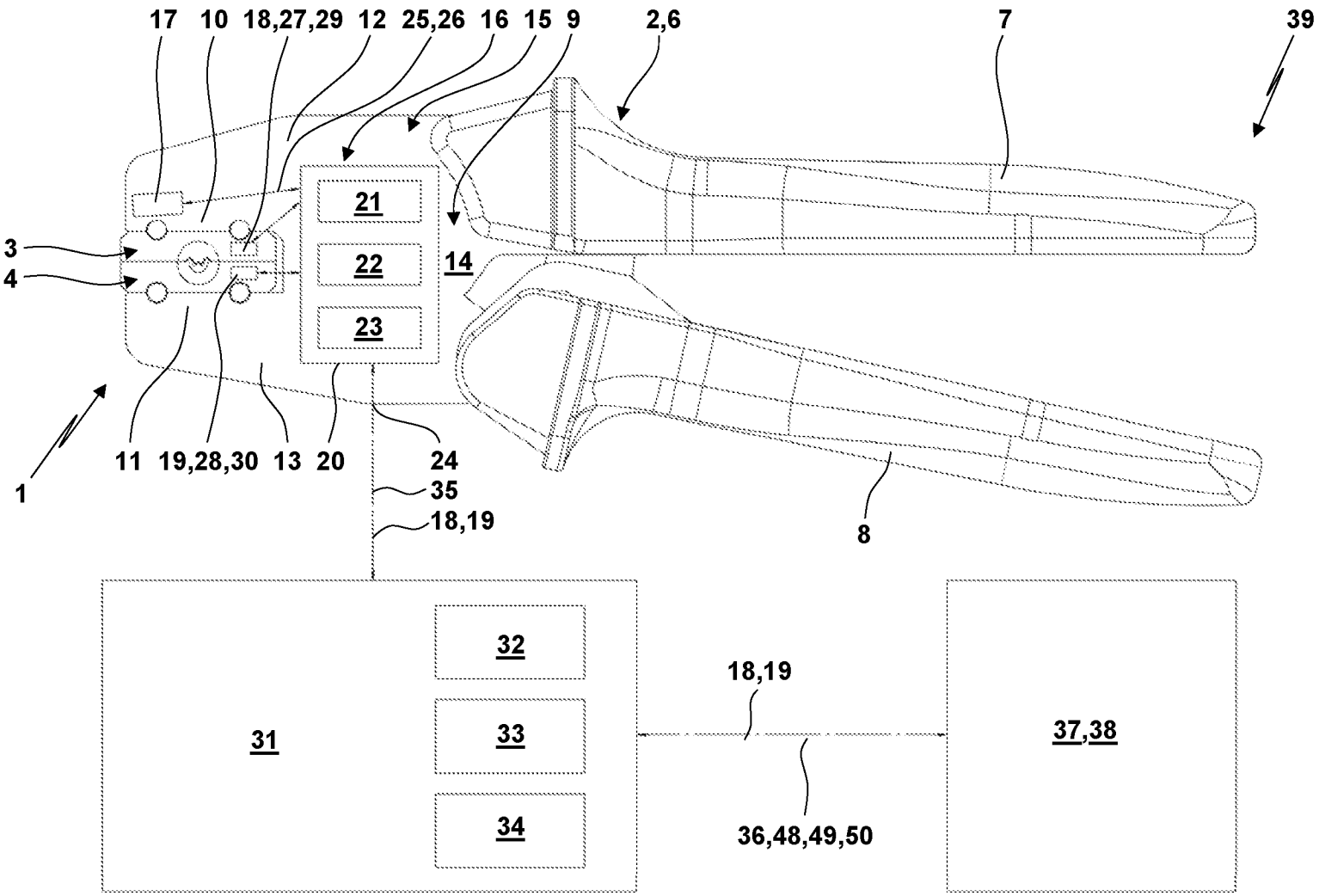
FIG. 1 schematically shows a pressing pliers network comprising a pressing pliers set, an external electronic control unit and an external data storage device, the pressing pliers set comprising pressing pliers and an exchangeable die.

FIG. 1 shows a pressing pliers set 1. The pressing pliers set 1 comprises pressing pliers 2 and an exchangeable pair of dies 3, 4. For the shown embodiment, the pressing pliers 2 are embodied as crimping pliers 6. The actuation of the pressing pliers 2 is provided by the user via a manual actuation of hand levers 7, 8. By a drive connection 9 not shown here the hand levers 7, 8 are connected to die accommodations 10, 11 in a way such that the relative pivoting movement of the hand levers 7, 8 towards each other leads to an opening movement or closing movement of the die accommodations 10, 11. The die accommodations 10, 11 are realized by pliers jaws 12, 13. The drive connection 9 here extends within a housing 14 of a mechanical pliers head 15.

The pressing pliers 2 comprise an electronic constructional group or electronic constructional unit 16 which is arranged adjacent to the die accommodations 10, 11. For the shown embodiment, the electronic constructional unit 16 is held by the housing 14 of the mechanical pliers head 15. Preferably, the electronic constructional unit 16 is arranged on both sides of the mechanical pliers head 15 where the electronic constructional unit partially or completely covers the mechanical pliers head 15. Concerning the constructive design of the electronic constructional unit 16, the electrical or electronic design of the electronic constructional unit 16 and/or the connection of the electronic constructional unit 16 to the mechanical pliers head 15 reference is made to the not pre-published European patent application with the official application number EP 18 173 803.0 which is incorporated by this reference into the present patent application.

The force flow of the pressing force biasing a die 3 at least partially flows via a sensor 17 which senses a pressing force biasing the die 3. Concerning options for the design of the sensor 17 and its integration into pressing pliers (here with a splitting of the pressing force to a pressing force part biasing the sensor 17 and another pressing force part bypassing the sensor 17 in a mechanical parallel connection) reference is made to the not pre-published European patent application EP 17 168 040.8-1809 which is incorporated by this reference into the present patent application.

The dies 3, 4 each comprise an identifier 18, 19 which is specific for the associated die 3, 4 or for the type of the die 3, 4.

The electronic constructional unit 16 comprises an identifier processing device 20 which comprises a capturing device 21, an electronic control unit 22, an output device 23 and an interface 24.

The identifier processing unit 20 on the one hand communicates with the sensor 17 for transmitting an actual pressing force signal 25 measured by the sensor 17 during the pressing stroke. It is possible that the sensor 17 or another sensor also senses an actual pressing displacement signal 26 during the crimping stroke. The identifier processing unit 20 (here the capturing device 21) captures the identifiers 18, 19 of the dies 3, 4. As mentioned in the beginning, this can be provided by capturing the identifier 18, 19 embodied as an optical coding by a camera or a scanner or a reading device of the capturing device 21, by capturing an identifier embodied as a mechanical contact contour by a mechanical scanning device, by an RFID unit 27, 28 of the dies 3, 4 which transmits the identifier 18, 19 which is then captured by the capturing device 21, by a near field communication or a radiation transmitter or light transmitter 29, 30 of the dies 3, 4, the transmitted light or transmitted radiation containing the identifier 18, 19 in coded form and the transmitted light or transmitted radiation being captured by the capturing device 21 or by an inductive coupling between the die 3, 4 and the capturing device 21 (for mentioning only some examples which are not intended to limit the present invention).

The identifier processing unit 20 (or the electronic constructional unit 16) communicates via the interface 24 with an external electronic control unit 31 which might be embodied as a personal computer, tablet, laptop or smartphone. The electronic control unit 31 comprises an output device 32, a data storage device 33 as well as a workpiece specification device 34. Preferably, the first communication link 35 between the interface 24 and the electronic control unit 31 is bi-directional. Furthermore, the electronic control unit 31 communicates by a second communication link 36 via suitable interfaces with a data storage device 37 (which is arranged externally from the control unit 31 and from the crimping tool set 1) which is preferably embodied as a cloud storage 38.

By means of the first communication link 35 the pressing pliers set 1 communicates with the control unit 31 which again by the second communication link 36 communicates with the data storage device 37. In this way, a pressing pliers network 39 is formed.

Figure 2:
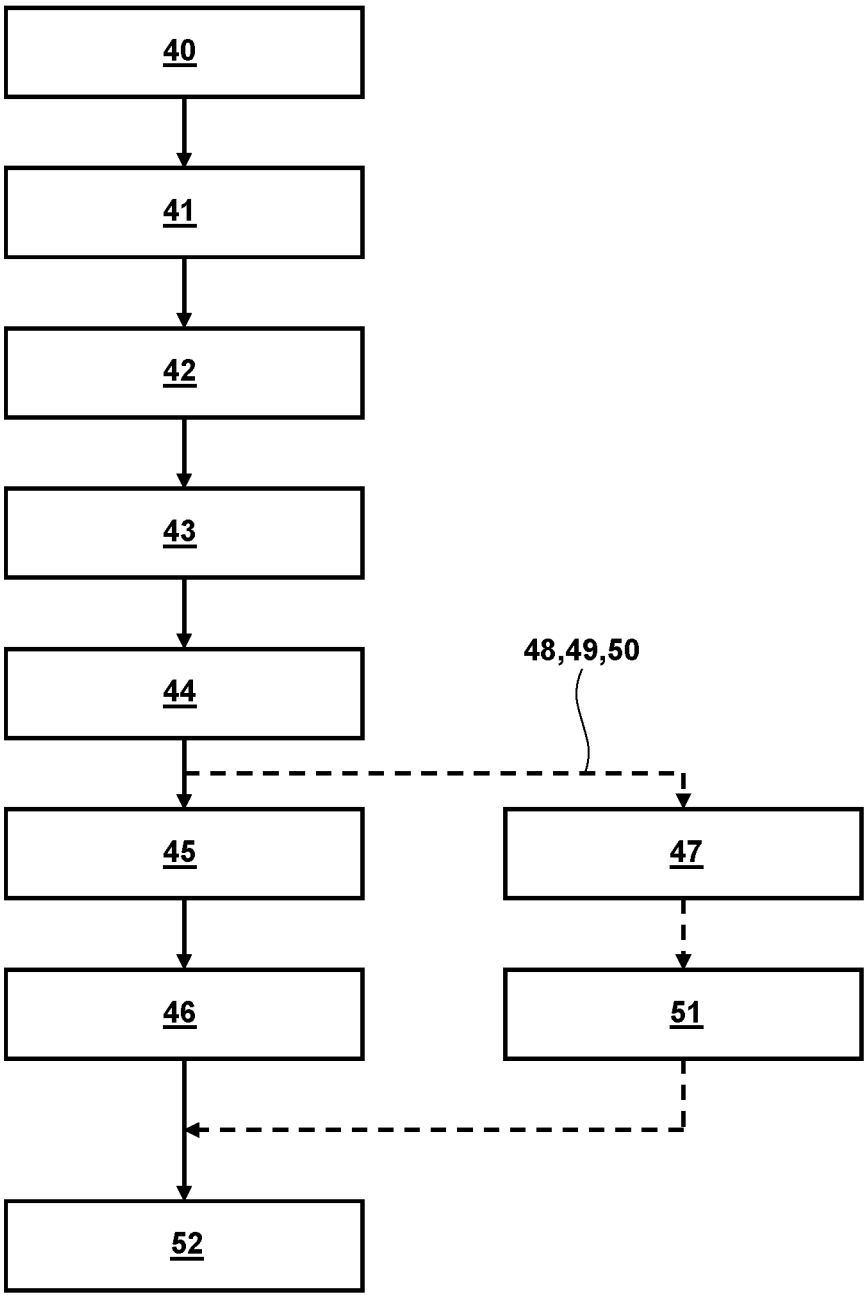
FIG. 2 schematically shows a method for pressing a workpiece with pressing pliers.

FIG. 2 shows a method for pressing a workpiece:

In a method step 40 a user selects dies 3, 4 from a plurality of pairs of dies and inserts the selected dies 3, 4 into die accommodations 10, 11 of pressing pliers 2.

In a method step 41 the identifiers 18, 19 of the dies 3, 4 are captured by the capturing device 21. As explained above, the capturing can be provided by capturing an optical identifier as a barcode or QR-code by means of a reading device, by a mechanical scanning of a scanning contour of the dies 3, 4, by means of a receipt of a signal of an RFID unit 27, 28 each being associated with a die 3, 4, by means of a capturing device 21, by an inductive coupling and the like.

In a method step 42, the captured identifier 18, 19 is processed by the control unit 22. It is possible that on the basis of this processing an output is generated at the output device 23. It is e.g. possible that at the output device 23 it is displayed (e.g. with an actual die number) which specific die 3, 4 is present or which type of die is present. It is also possible that the output device 23 displays the number of working strokes that have been passed by the dies 3, 4 where, when exceeding a threshold of the number of working strokes, it is also possible that the output device 23 displays a demand for exchanging the dies 3, 4. Here, it is possible that information required for the analysis (as the number of working strokes that have been run through by the dies 3, 4 and which have been counted by a suitable counting device of the pressing pliers 2, a correlation of the different identifiers 18, 19 of different pairs of dies to a type of workpiece and the like) is stored in a storage unit of the identifier processing device 20 or of the electronic constructional unit 16. However, for the embodiment described here this is not the case.

Instead, in a method step 43 the identifier 18, 19 (or an information determined therefrom by the control unit 22 due to the processing) is transmitted via the interface 24 by means of the first communication link 35 to the control unit 31, which is e.g. a smartphone or a tablet. Here, the transmission is preferably provided wirelessly by WLAN or via bluetooth or cable-based.

In a method step 44, the control unit 31 again transmits the identifiers 18, 19 (or an information determined therefrom, in some cases also with a further processing by the control unit 31) via the second communication link 36 to the data storage device 37 which is in particular embodied as a cloud storage 38. In the data storage device 37 a correlation of the identifiers 18, 19 or information determined therefrom with types or components of workpieces which can be processed with the dies 3, 4 associated with the identifiers 18, 19 are stored.

Due to this correlation and a communication to the control unit 31 and/or to the control unit 22 it is possible that in a method step 45 information is provided in the control unit 31 and/or in the control unit 22 for which workpiece, for which type of workpieces or which types of workpieces or configurations of the same the dies 3, 4 arranged in the die accommodations 10, 11 are designated.

In a method step 46, this information can be brought to the knowledge of the user by the output device 23 and/or the output device 32. It is e.g. possible that in the method step 46 on a display of the smartphone it is displayed to the user which plugs, which cable and/or which sealing can be crimped with the dies 3, 4 being inserted into the pressing pliers 2.

It is e.g. also possible that the user inputs a product number or type number of the workpiece or of components via the workpiece specification device 34 of the control unit 31. The control unit 31 displays to the user that the crimping of this workpiece or the component of the same is admissible with the dies 3, 4 or not.

It is optionally, alternatively or cumulatively possible that in a method step 47 data 48 is provided to the control unit 31 from the data storage device 37, the data 48 being specific for the captured identifiers 18, 19 and the data 48 e.g. being a desired pressing force curve 49 and/or a desired pressing displacement curve 50, inclinations of the same, maxima, minima and the like. If then a workpiece is pressed with the pressing pliers 2, the actual pressing force signal 25 and/or the actual pressing displacement signal 26 sensed by the sensor 17 is transmitted by the control unit 22 via the first communication link 35 to the control unit 31. By means of the control unit 31 then in a method step 51 the crimping process is evaluated under consideration or comparison of the desired pressing force curve 49 and/or the desired pressing displacement curve 50 on the one hand and the actual pressing force signal 25 and/or the actual pressing displacement signal 26. An evaluation of this type might be used for the examination if the inserted dies 3, 4 are admissible for being used for the workpiece pressed therein because a pressing of a workpiece not being suitable (in particular with a non-fitting diameter, a stiffness which is not adequate and/or a non-fitting geometry) leads to a deviation of the actual pressing force signal 25 from the desired pressing force curve 49 outside of a tolerance region (the tolerance region might also be transmitted by the data storage device 37 via the second communication link 36 to the control unit 31). However, even if an admissible workpiece is crimped by the dies 3, 4, by means of the comparison, a process monitoring can be provided for monitoring if the workpiece has been inserted into the dies 3, 4 according to the specifications and if the pressing stroke has been run through according to the specifications. If this is not the case, also the actual pressing force signal 25 is outside from the tolerance region of the desired pressing force curve 49. By the output device 32 then a corresponding output is generated (so e.g. an output of the type that the workpiece is admissible or not admissible for being pressed by the dies 3, 4, that the pressing stroke has been run through according to the specifications or not or it is even possible that the actual pressing force signal over time is played or the actual pressing displacement signal is displayed and/or the desired pressing force curve over time or over the desired pressing displacement curve is displayed, in some cases also with the display of the tolerance region). Accordingly, it can be brought to the knowledge of the user where the actual pressing force signal 25 has been within the tolerance region and that in some cases the tolerance region has been left.

In a method step 52, then a documentation is provided by making an entry into a data storage device of the pressing pliers 2 (so of the electronic constructional unit 16 or the identifier processing device 20), into the data storage device 33 and/or into the data storage device 37.

In order to mention only one example that is not intended to limit the present invention, the entry might be the date of the execution of the pressing stroke, the captured identifier 18, 19, any data related to the inserted workpiece captured by the workpiece specification device 34 or input, data related to the result of the evaluation of the pressing process as e.g. the actual pressing force signal 25 and/or the actual pressing displacement signal 26.

It is optionally possible that by means of the workpiece specification device 34 (which might base on a captured image of a workpiece which is to be pressed with an image processing for identifying the workpiece or components of the same or which might base on a manual input of ciphers) the workpiece which is designated for being pressed by the pressing pliers 2 is specified. This specification of the workpiece can then also be documented by entry in the method step 52. It is also possible that then in the control unit 31 it is analyzed if an admissible combination of the specified workpiece and the dies 3, 4 is present where the result can then be displayed by the output device 34. It is alternatively or cumulatively possible that for the specific workpiece characteristic data 48 being specific for the specified workpiece are provided from the data storage device 37 to the control unit 31 (as e.g. desired pressing force curves 49 and desired pressing displacement curves 50 being specific for the combination of dies 3, 4/specified workpiece) which can then be used as the basis for the above-described evaluation. It is also possible that on the basis of the specification of the workpiece which is to be crimped, the specification being sensed by the workpiece specification device 34 or input into the workpiece specification device 34 an image is produced at a displaying device for the user indicating which suitable die has to be inserted into the die accommodation.

It is also possible that the identifier processing device 20 or the electronic constructional unit 16 comprises a GPS unit by which it is possible to automatically determine a position of the pressing pliers 2. The position determined in this way can then be transmitted by the first communication link 35 to the external electronic control unit 31. It is then possible to display the position of the pressing pliers 2 at the external electronic control unit 31 for the user, in some cases also with indications to the route leading to the pressing pliers 2. In this way, it is easier for the user to retrieve the pressing pliers 2 in cases where the user has deposited the pressing pliers 2 at some place. However, it is also possible that the die 3, 4 comprises a GPS unit the signal of which can then be transmitted (by the electronic constructional unit 16 or independent on the electronic constructional unit 16) to the external electronic control unit 31 so that also the external electronic control unit 31 is aware of the position of the die and is able to display the position of the die.

As another option, the pressing pliers 2 might be able to allow a communication with a storage device for the pressing pliers 2 and preferably for a plurality of further tools. The storage device might e.g. be a tool box, a tool trolley or a tool crib. By means of the communication the storage device is informed that the pressing pliers 2 are arranged in the storage unit. This might e.g. be provided automatically in the way that when the pressing pliers 2 are arranged in the storage device a signal sent by the pressing pliers and specifying the pressing pliers 2 propagates in the receiving region of a receiver of the storage device. The storage device might then give an overview to a user on the tools arranged within the storage device and might here in particular give the information if the pressing pliers 2 are arranged in the storage device or not. The corresponding also applies for the dies 3, 4.

Figure 3:
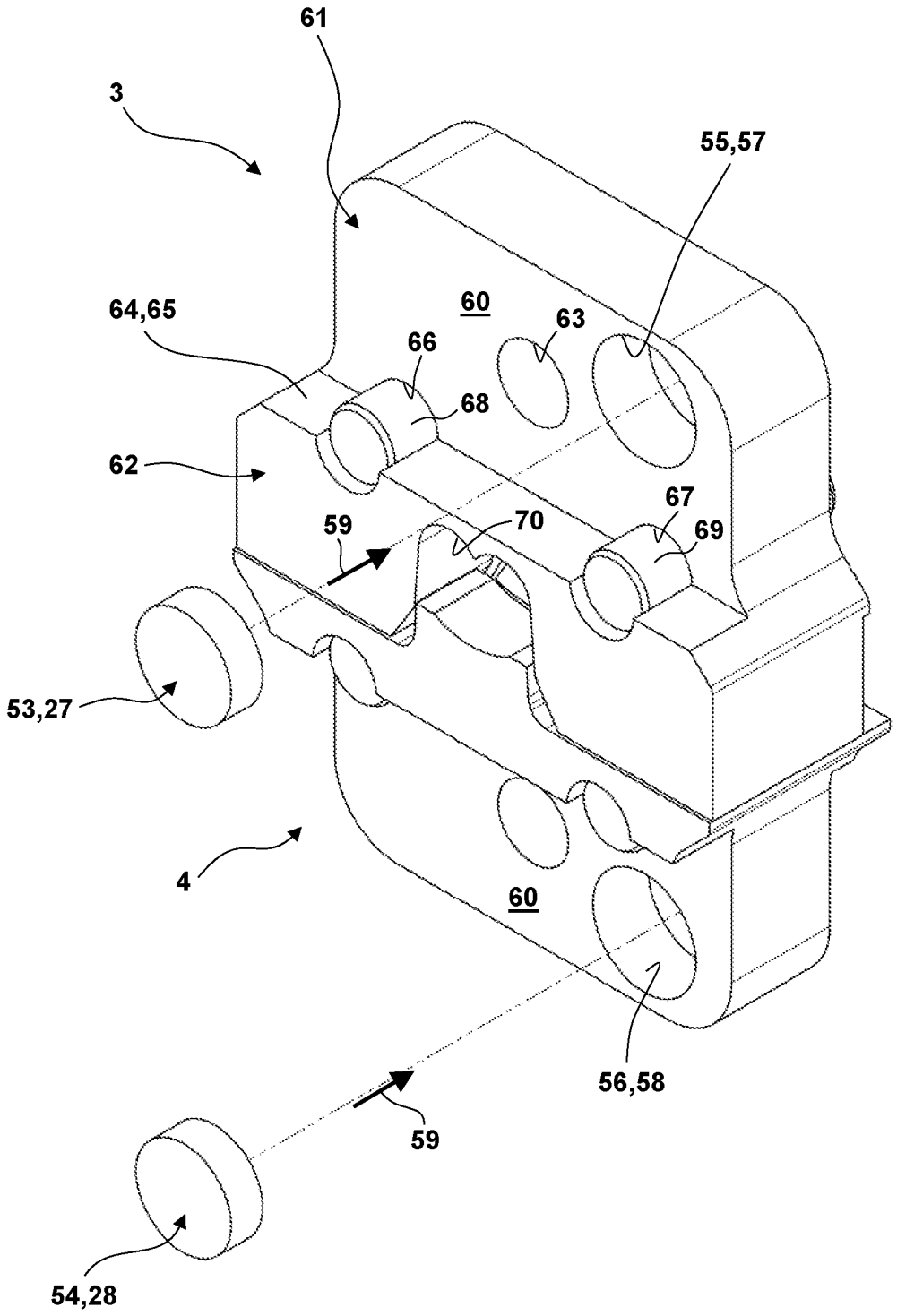
FIG. 3 in a three-dimensional view shows two dies comprising transmitting units for an identifier arranged therein.

FIG. 3 shows dies 3, 4 into which each a transmitting unit 53, 54 for the identifier 18, 19 is integrated. It is generally possible that the transmitting units 53, 54 comprise a battery or a rechargeable accumulator so that the transmitting units 53, 54 are able to actively transmit the identifiers 18, 19 which is in particular triggered by a suitable activation signal of the identifier processing unit 20. However, preferably the transmitting units 53, 54 are embodied as RFID units 27, 28. According to FIG. 3, the dies 3, 4 comprise recesses 55, 56 which are here embodied as blind bores 57, 58. With an accurate fit the transmitting units 53, 54 are accommodated in the recesses 55, 56. For this purpose, the transmitting units 53, 54 might e.g. have a cylindrical design or a design similar to a coin cell. It is possible that a housing of the transmitting units 53, 54 is freely accessible within the dies 3, 4 in an assembly direction 59 along which the transmitting units 53, 54 are inserted into the recesses 55, 56 and which might correspond to the longitudinal axis of the blind bores 57, 58 or opposite to this direction. Accordingly, the identifier 18, 19 transmitted from the transmitting unit 53, 54 is not weakened or obstructed by the dies 3, 4. It is also possible that the capturing device 21 of the identifier processing device 20 is arranged in the region of the axis defined by the assembly direction 59 so that the identifier 18, 19 sent out by the transmitting units 53, 54 can be received without any redirections. It is also possible that after the insertion of the transmitting units 53, 54 into the associated recesses 55, 56 the transmitting unit 53 is covered in outer direction (so opposite to the assembly direction 59) by a layer of a varnish. This layer of a varnish should allow the passing of the signal which contains the identifier 18, 19 and which is sent by the transmitting units 53, 54 without an excess weakening or damping of this signal. Furthermore, the layer of the varnish might seal an interior chamber of the recess 55, 56, wherein the transmitting unit 53, 54 is accommodated in outer direction so that the entry of humidity and/or contaminations can be avoided. Finally, it is possible that by means of the layer of the varnish a protective effect can be achieved for the transmitting unit 53, 54 against mechanical damages. Preferably, a housing of the transmitting units 53, 54 or the layer made of the varnish or any other cover is flush with an outer surface 60 of the die 3, 4.

Figure 4:
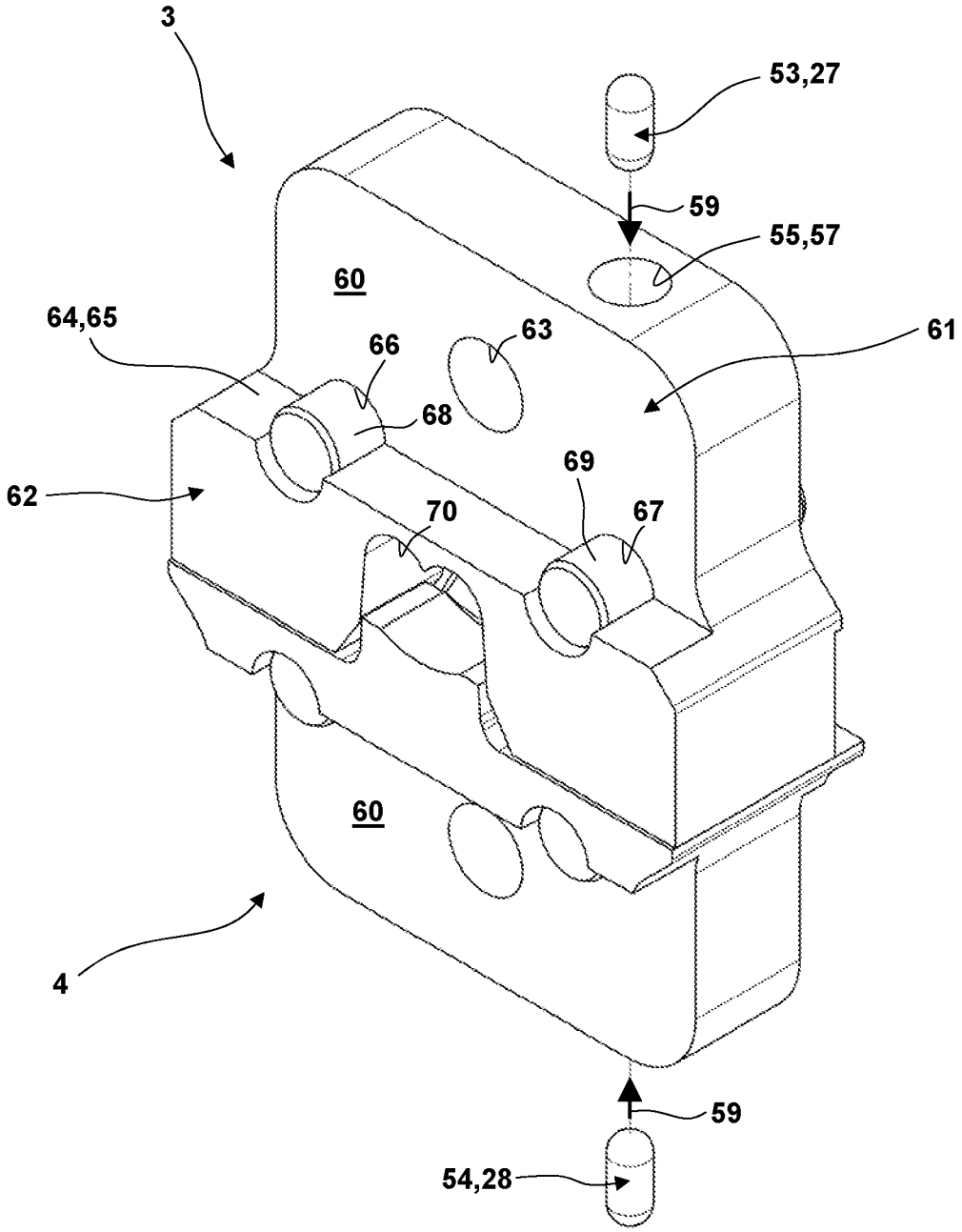
FIG. 4 in a three-dimensional view shows an alternative embodiment of two dies comprising transmitting units for an identifier arranged therein.

For the embodiments of FIGS. 3 and 4, the dies 3, 4 are generally designed as described in the patent publication DE 198 02 287 01. This will as an example be explained on the basis of the die 3, where the corresponding also applies for the die 4. The die 3 comprises a flange section 61 and a die section 62. The flange section 61 has a plate-like design. The flange section 61 is accommodated with a transitional fit or a play between pliers jaw plates of the associated pliers jaw 12. The flange section 61 comprises a through bore 63 which has an orientation transverse to the crimping force biasing the die 3 and transverse to the pivoting plane of the dies 3, 4 and so of the pliers jaws 12, 13. In the state assembled to the pliers jaw a fixing screw or fixing pin extends through the through bore 63. The fixing screw or fixing pin is held in both end region in the aforementioned pliers jaw plates of the associated pliers jaw 12. In a transition region 64 between the flange section 61 and the die section 62 a step 65 might be provided (without this necessarily being the case). In the transition region 64 a base body of the die 3 comprises two bores 66, 67 having an orientation parallel to each other and having an orientation vertical to the crimping force biasing the die 3 and having an orientation vertical to the pivoting plane of the dies 3, 4. Bearing elements 68, 69 are held in the bores 66, 67. Preferably, the bearing elements 68, 69 are embodied as bolts or pins which are accommodated in the bores 66, 67 with an accurate fit. When the die 3 is assembled to the pliers jaw 12, the end regions of the bearing elements 68, 69 protruding from the flange section 61 (here half-cylindrical outer surfaces of the pins or bolts) contact concave accommodations of the pliers jaw plates having a corresponding shape. In this way, the holding and guiding of the die 3 at the associated pliers jaw 12 is provided.

The die section 62 protrudes towards the other die out of the pliers jaw plates and serves for providing the die contour 70. With respect to further details for the general design of the dies 3, 4, reference is made to the patent publication DE 198 02 287 01.

For the embodiment of FIG. 3, the transmitting unit 53, 54 is arranged in the flange section 61. Accordingly, in the state of the dies 3, 4 assembled to the pressing pliers 5 the transmitting units 53, 54 are protected by the pliers jaw plates. Here, preferably the recesses 55, 56 are arranged on the side of the flange section 61 facing away from the die section 62.

FIG. 4 shows another example for the integration of the transmitting units 53, 54 into the dies 3, 4. Here, indeed also the transmitting units 53, 54 are arranged in the flange section 61 of the dies 3, 4. However, the recesses 55, 56 (here blind bores 57, 58) are arranged with an extension in the pliers head plane where preferably one direction of the extension of the recesses 55, 56 or of the blind bores 57, 58 is parallel to the pressing force. Preferably, the pressing pliers 2 comprise a hollow space in the region of an axis defining the assembly direction 59, the hollow space preferably being formed between the pliers jaw plates. The hollow space provides a good signal transmission. The identifier processing device 20 or the capturing device 21 might then directly adjoin to this hollow space or other components or material section might be arranged between the hollow space and the capturing device 21.

Various other kinds of integration of the transmitting units 53, 54 into the dies 3, 4 are possible. To mention only some non-limiting examples, a recess or an inner chamber of a die 3, 4 wherein the transmitting unit 53, 54 is arranged can be closed by a lid. It is also possible that the flange section 61 or the whole die 3 is formed by two half shells which then form the inner chamber for accommodating the transmitting unit 53, 54 where the two half shells can be connected to each other with a provision of a sealing effect of the inner space by a material bond (e.g. by adhering or welding).

The distance of a transmitting unit 53, 54 from an associated capturing device 21 is preferably smaller than 3 cm, smaller than 2 cm, smaller than 1.5 cm or even smaller than 1 cm. This distance extends at least partially through the aforementioned hollow chamber of the pressing pliers 2 so that a good signal transmission is provided.

In the case that the identifier 18, 19 or the transmitting unit 53, 54 comprises an RFID, the corresponding applies for an excitation signal for a power supply of the RFID sent by the identifier processing unit 20.

I claim:

1. A pressing pliers network comprising:

manual pressing pliers for pressing a workpiece, the manual pressing pliers comprising:

hand levers for manually actuating the manual pressing pliers, a die accommodation, an exchangeable die that can be accommodated in the die accommodation, an identifier of the die, a capturing device which is configured for capturing the identifier of the die, an electronic control unit being embodied externally from the manual pressing pliers and being arranged separately from the manual pressing pliers, a first communication link between the capturing device of the manual pressing pliers and the electronic control unit, an external data storage device on which data is stored, a second communication link between the electronic control unit and the external data storage device on which data is stored and an output device of the electronic control unit or of the manual pressing pliers, the electronic control unit comprising control logic which on a basis of the identifier of the die captured by the capturing device and transmitted via the first communication link and of data from the data storage device being specific for the captured identifier and being transmitted via the second communication link generates an output of the output device which contains an information for a type of workpiece which can be pressed with the die inserted into the pressing pliers.

2. The pressing pliers network of claim 1, wherein the capturing device is arranged in a region of a pliers head of the pressing pliers.

3. The pressing pliers network of claim 2, wherein the capturing device is arranged adjacent to the die accommodation.

4. The pressing pliers network of claim 1, wherein the capturing device comprises at least one of a reading device for reading an identifier embodied as an optical coating and a mechanical scanning device for scanning an identifier embodied as a mechanical contact contour and a receiving unit for receiving a signal sent by a radio frequency identification (RFID) unit of the die, the signal containing the identifier or forming the same and a receiver receiving a radiation signal or light signal which forms or contains the identifier and an inductive coupling device for providing an inductive coupling between the die and the capturing device.

5. The pressing pliers network of claim 1, wherein the captured identifier of the die is at least one of a type of the die and a unique specific identifier of the die and an authentication of the die.

6. The pressing pliers network of claim 1, wherein the exchangeable die comprises a transmitting unit for transmitting the identifier, the transmitting unit being arranged in a recess or in an inner chamber of the die.

7. The pressing pliers network of claim 1, wherein the electronic control unit comprises control logic which on the basis of the identifier of the die captured by the capturing device and transmitted via the first communication link to the electronic control unit and on the basis of data transmitted from the data storage device via the second communication link to the electronic control unit controls an output of an output device or an entry into a storage unit which contains an information that the die is not authenticated for a use in the pressing pliers.

8. The pressing pliers network of claim 1, wherein the electronic control unit comprises control logic which loads characteristic data concerning a desired pressing force curve or concerning a desired pressing displacement curve which is specific for the captured identifier from the data storage device via the second communication link to the electronic control unit, the pressing pliers comprises at least one sensor or switch for sensing an actual pressing force signal or an actual pressing displacement signal when running through a pressing stroke during which in a pressing process a workpiece is pressed by the die arranged in the die accommodation and the electronic control unit comprises control logic by which an evaluation of the pressing process is provided under consideration of characteristic data of the desired pressing force curve or the desired pressing displacement curve and of the actual pressing force signal or the actual pressing displacement signal.

9. A pressing pliers network comprising:

manual pressing pliers for pressing a workpiece, the manual pressing pliers comprising hand levers for manually actuating the manual pressing pliers, a die accommodation, an exchangeable die that can be accommodated in the die accommodation, an identifier of the die, a capturing device which is configured for capturing the identifier of the die and an electronic control unit being embodied externally from the manual pressing pliers and being arranged separately from the manual pressing pliers, a workpiece specification device of the manual pressing pliers or of the electronic control unit which is configured such that it is possible to input or capture a workpiece specifier of a workpiece which is designated for being pressed by the manual pressing pliers, a first communication link between the capturing device of the manual pressing pliers and the electronic control unit, an external data storage device on which data is stored, a second communication link between the electronic control unit and the external data storage device on which data is stored and an output device of the manual pressing pliers or of the electronic control unit, where the electronic control unit comprises control logic which on a basis of the identifier of the die captured by the capturing device of the manual pressing pliers and transmitted from the manual pressing pliers via the first communication link to the electronic control unit, the workpiece specifier input into the workpiece specification device or captured by the workpiece specification device and data transmitted from the data storage device via the second communication link to the electronic control unit analyses if the die is suitable for pressing the workpiece having the workpiece specifier; and the control logic generates an output at the output device which depends on a result of the analysis.

10. The pressing pliers network of claim 9, the electronic control unit comprising control logic which on the basis of the identifier of the die captured by the capturing device and transmitted via the first communication link and of data from the data storage device being specific for the captured identifier and being transmitted via the second communication link generates an output of the output device which contains an information for a type of workpiece which can be pressed with the die inserted into the pressing pliers.

11. The pressing pliers network of claim 9, wherein the capturing device is arranged in a region of a pliers head of the pressing pliers.

12. The pressing pliers network of claim 11, wherein the capturing device is arranged adjacent to the die accommodation.

13. The pressing pliers network of claim 9, wherein the capturing device comprises at least one of:

a reading device for reading an identifier embodied as an optical coating and a mechanical scanning device for scanning an identifier embodied as a mechanical contact contour and a receiving unit for receiving a signal sent by a radio frequency identification (RFID) unit of the die, the signal containing the identifier or forming the same and a receiver receiving a radiation signal or light signal which forms or contains the identifier and an inductive coupling device for providing an inductive coupling between the die and the capturing device.

14. The pressing pliers network of claim 9, wherein the captured identifier of the die is at least one of:

a type of the die and a unique specific identifier of the die and an authentication of the die.

15. The pressing pliers network of claim 9, wherein the exchangeable die comprises a transmitting unit for transmitting the identifier, the transmitting unit being arranged in a recess or in an inner chamber of the die.

16. The pressing pliers network of claim 9, wherein the electronic control unit comprises control logic which on the basis of the identifier of the die captured by the capturing device and transmitted via the first communication link to the electronic control unit and on the basis of data transmitted from the data storage device via the second communication link to the electronic control unit controls an output of an output device or an entry into a storage unit which contains an information that the die is not authenticated for a use in the pressing pliers.

17. The pressing pliers network of claim 9, wherein the electronic control unit comprises control logic which loads characteristic data concerning a desired pressing force curve or concerning a desired pressing displacement curve which is specific for the captured identifier from the data storage device via the second communication link to the electronic control unit, the pressing pliers comprises at least one sensor or switch for sensing an actual pressing force signal or an actual pressing displacement signal when running through a pressing stroke during which in a pressing process a workpiece is pressed by the die arranged in the die accommodation and the electronic control unit comprises control logic by which an evaluation of the pressing process is provided under consideration of characteristic data of the desired pressing force curve or the desired pressing displacement curve; and of the actual pressing force signal or the actual pressing displacement signal.

18. A method for pressing a workpiece under use of a pressing pliers network, wherein the pressing pliers network comprises:

manual pressing pliers for pressing a workpiece, the manual pressing pliers comprising:

hand levers for manually actuating the manual pressing pliers, a die accommodation, an exchangeable die that can be accommodated in the die accommodation, an identifier of the die, a capturing device which is configured for capturing the identifier of the die, an electronic control unit being embodied externally from the manual pressing pliers and being arranged separately from the manual pressing pliers, a first communication link between the capturing device of the manual pressing pliers and the electronic control unit, an external data storage device on which data is stored, a second communication link between the electronic control unit and the external data storage device on which data is stored, and an output device of the electronic control unit or of the manual pressing pliers, the electronic control unit comprising control logic which on a basis of the identifier of the die captured by the capturing device and transmitted via the first communication link and of data from the data storage device being specific for the captured identifier and being transmitted via the second communication link, generates an output of the output device which contains an information for a type of workpiece which can be pressed with the die inserted into the pressing pliers, wherein the method comprises the following method steps:

the die is inserted into the pressing pliers, by the capturing device of the pressing pliers the identifier of the die is captured, data is downloaded via the second communication link from the data storage device, the data containing information being specific for the captured identifier and the information indicating which at least one type of a workpiece can be pressed with the die inserted into the pressing pliers and information indicating which at least one type of workpiece can be pressed with the die is output by an output device.

19. The method for pressing a workpiece according to claim 18, the method comprising the following additional method steps:

characteristic data concerning a desired pressing force curve or a desired pressing displacement curve which is specific for the captured identifier is downloaded via the second communication link from the data storage device, a sensor senses an actual pressing force signal or an actual pressing displacement signal during a pressing stroke by which a workpiece is pressed in a pressing process with the die, an evaluation of the pressing process is provided under consideration of the data of the desired pressing force curve or the desired pressing displacement curve and the actual pressing force signal or the actual pressing displacement signal.

20. A method for pressing a workpiece under use of a pressing pliers network, wherein the pressing pliers network comprises:

manual pressing pliers for pressing a workpiece, the manual pressing pliers comprising hand levers for manually actuating the manual pressing pliers, a die accommodation, an exchangeable die that can be accommodated in the die accommodation, an identifier of the die, a capturing device which is configured for capturing the identifier of the die and an electronic control unit being embodied externally from the manual pressing pliers and being arranged separately from the manual pressing pliers, a workpiece specification device of the manual pressing pliers or of the electronic control unit which is configured such that it is possible to input or capture a workpiece specifier of a workpiece which is designated for being pressed by the manual pressing pliers, a first communication link between the capturing device of the manual pressing pliers and the electronic control unit, an external data storage device on which data is stored, a second communication link between the electronic control unit and the external data storage device on which data is stored and an output device of the manual pressing pliers or of the electronic control unit, where the electronic control unit comprises control logic which on a basis of the identifier of the die captured by the capturing device of the manual pressing pliers and transmitted from the manual pressing pliers via the first communication link to the electronic control unit, the workpiece specifier input into the workpiece specification device or captured by the workpiece specification device and data transmitted from the data storage device via the second communication link to the electronic control unit analyses if the die is suitable for pressing the workpiece having the workpiece specifier; and the control logic generates an output at the output device which depends on a result of the analysis, wherein the method comprises the following method steps:

the die is inserted into the pressing pliers, by the capturing device of the pressing pliers the identifier of the die is captured, by the workpiece specification device a workpiece specification of a workpiece which is designated for being pressed with the pressing pliers is captured or input, on the basis of the captured identifier of the die captured by the capturing device and on the basis of the workpiece specification an analysis is performed if the die is suitable for pressing the workpiece comprising the workpiece specifier and dependent on the result of the analysis an entry and/or an output is generated.

* * * * *